United States Patent [19]

Mitzel et al.

[11] 4,339,221

[45] Jul. 13, 1982

[54] PORTABLE INPUT MAGAZINE

[75] Inventors: Wilhelm Mitzel, Neu-Keferlof; Herbert Bernardi, Haag; Rudolf Duschek, Munich, all of Fed. Rep. of Germany

[73] Assignee: G.A.O. Gesellschaft fuer Automation und Organisation mbH, Fed. Rep. of Germany

[21] Appl. No.: 115,032

[22] Filed: Jan. 24, 1980

Related U.S. Application Data

[62] Division of Ser. No. 867,011, Jan. 5, 1978, Pat. No. 4,236,639.

[30] Foreign Application Priority Data

Jul. 1, 1977 [DE] Fed. Rep. of Germany ..... 2729830

[51] Int. Cl.[3] ..... B65H 1/04

[52] U.S. Cl. ..... 414/114; 221/154; 312/42; 414/416; 414/417; 414/786

[58] Field of Search ..... 414/114, 118, 119, 416, 414/417, 786; 271/162, 163, 164, 263; 221/65, 154, 197, 198; 53/381 R, 492; 194/DIG. 26; 209/534, 548, 559, 563, 564, 565; 493/374; 312/42, 60, 50, 61, 247, 306

[56] References Cited

U.S. PATENT DOCUMENTS

| | | | |
|---|---|---|---|
| 1,779,004 | 10/1930 | Krell | 312/306 |
| 2,431,523 | 11/1947 | Tuerff et al. | 221/198 |
| 3,560,067 | 2/1971 | Stieg | 312/42 |
| 3,976,198 | 8/1976 | Carnes et al. | 209/534 |
| 4,095,781 | 6/1978 | Kistner et al. | 271/263 X |
| 4,113,140 | 9/1978 | Graef et al. | 221/227 X |
| 4,189,139 | 2/1980 | Uchida et al. | 271/162 |

FOREIGN PATENT DOCUMENTS

| | | |
|---|---|---|
| 1941746 | 9/1970 | Fed. Rep. of Germany . |
| 2202930 | 8/1972 | Fed. Rep. of Germany . |
| 2446280 | 4/1975 | Fed. Rep. of Germany . |

*Primary Examiner*—Leslie J. Paperner
*Attorney, Agent, or Firm*—McGlew and Tuttle

[57] ABSTRACT

An apparatus for separating a strap from a packet of thin sheets, such as bank notes, bound by the strap includes a housing, a magazine disposed within the housing having a receptacle and a drawer-like member received in the receptacle. A plurality of the packets are disposed in the drawer-like member which can be moved by a mechanism in the housing so that a portion of the drawer having a packet is exposed to an ejector member in the housing. The ejector member is operative to eject the exposed packet. Means are provided for engaging the strap and stack of the exposed packet. The means are operated to separate the stack and the strap.

25 Claims, 5 Drawing Figures

PORTABLE INPUT MAGAZINE

This application is a division of application Ser. No. 867,011 filed June 5, 1978 now U.S. Pat. No. 4,236,639.

FIELD AND BACKGROUND OF THE INVENTION

This invention relates in general to a portable input magazine for a device for automatically sorting and testing thin paper sheets such as paper money, bills or bank notes, and, more particularly, to a new and useful apparatus and method for separating a strap from a packet having a stack of thin sheets, such as bank notes, bound by the strap.

Pieces of paper money have only a limited life. After a certain period of time, paper currency must be withdrawn from circulation, destroyed and replaced by new bills. Previously, such operations have been performed manually. Such work can be done only by reliable individuals, is highly expensive in labor costs and also tiresome, so that errors due to inadvertence can never be fully eliminated.

Therefore, it is desirable to automate the respective operations. Published patent application (DT-OS) German OS No. 2,446,280, corresponding to U.S. Pat. No. 4,025,420 discloses a bill sorting device which permits the automatic testing of large quantities of bill for fitness for circulation. To carry out this sorting operation, the bills, which are initially available in strapped packs, are manually unstrapped and placed in quantities of 1,000 pieces in a respective magazine. Both the top and the bottom of a single unstrapped pack are in the magazine by special sorting cards. Then, the bills are removed from the magazine by means of a special withdrawal mechanism and transferred to a belt conveyor to be transported past certain testing apparatus or to a sorting device.

The magazines are filled at a location which is remote from the bill sorting device. At that location, first, the strapped packs of bills must be unstrapped, separating sorting cards must be inserted into the stack of bills, and the stack must be placed in the magazine. Thereupon, the magazine must be transported to the bill sorting device and positioned so as to enable the withdrawing mechanism wo withdraw the bills individually from the magazine.

Handling of bills requires particular security measures. With the prior art magazine, access from the outside to the contents of the magazine is possible, both during the phase of filling after unstrapping the packs and later during the transportation and segregation of the bills. Increased security expenditures are therefore necessary to avoid irregularities.

SUMMARY OF THE INVENTION

The invention is directed to a development of an input magazine of the known kind eliminating any access to the once filled magazine by unauthorized persons and any manipulations with the contents of the container in a sorting device during the separation of the bills.

In accordance with the invention, an apparatus is provided for separating a strap from a packet having a stack of thin sheets, such as paper bank notes, bound by the strap. The apparatus includes a housing, a magazine disposed within the housing having a receptacle and a drawer member movably received in the receptacle and adapted to contain a plurality of the packets. The drawer member has a rear wall, a side wall, at least one end wall and a front with an opening dimensioned to pass at least one packet. A rear wall has a slot proximate the end wall and opposite the opening. Moving means are mounted in the housing for moving the end wall and at least part of the drawer member containing one of the packets out of the receptacle. Ejector means are pivotally mounted in the housing and extendable through the slot of the drawer member when at least part of the drawer member is moved out of the receptacle to eject at least part of one of the packets from the drawer member. First gripping means engageable with the strap of a packet so ejected and second gripping means engageable with a stack of the ejected packets are provided in the housing. The second gripping means is operative to move the stack relative to the strap and thereby the strap from the stack.

In accordance with an embodiment of the invention, means, such as a pressure sensor, are mounted in the housing for terminating the advance of the drawer in relation to the stiffness of one of the packets. In accordance with still another feature of the invention, the drawer member is movable relative to the receptacle between a closed first position and a second position in which at least one of the packets may be ejected from the drawer through the opening. In a further advantageous embodiment of the invention, means are provided for locking the drawer member in the closed first position.

In accordance with still a further feature of the invention, the drawer member includes an opposite end opposite the end wall which is provided with a drawer aperture. The moving means is operative through the drawer aperture for pushing the packets into engagement with the end wall and causing the drawer to advance at least partially out of the receptacle. The receptacle may include an aperture in a portion thereof adjacent to the opposite and aligned with the drawer aperture such that the moving means is operative through the receptacle aperture. In addition, a plate member may be movably disposed in the drawer intermediate the opposite ends and the plurality of packets.

In accordance with still another feature of the invention, an adaptor member may be fixedly received in the drawer member to line the drawer member member at least along part of the side walls and the rear wall so as to adopt the packet containing volume of the drawer member to the dimension of the packets contained therein. The adapter member may have a separating slot at least partly opposite the slot of the rear wall to facilitate pivoting of the packet when engaged by the ejector member.

In accordance with the invention, a method of separating a strap from a packet having a stack of the thin sheets, such as bank notes, is provided. The method includes delivering a plurality of the packets in a locked container of the type having a drawer member containing the packets movably received within a receptacle to a housing, and locking the container within the housing, moving the drawer at least partly out of the receptacle into alignment with an ejector means mounted in the housing, operating the ejector means to eject at least part of one of the packets from the drawer, gripping the strap of the ejected packet with a first gripping means and gripping the strap of the ejected packet with a second gripping means, and moving the first and second gripping means relative to each other to separate the strap and the stack.

This substantially simplifies the monitoring of the contents of receptacles, since the group of persons having access to the contents of the receptacles is clearly defined and no manipulation of the filled magazines is possible, not even during their intermediate storage. Since even during their presence in unlocked state within the sorting device, the contents of the magazines are not accessible from the outside. Any manipulation can also be prevented during the treatment of a magazine in the sorting device. This additionally increases the general security and further reduces the hitherto incurred costs of supervision.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

It is a further object of the invention to provide an apparatus for separating a strap from a packet having a stack of thin sheets, such as bank notes, bound by the strap, which is simple in design, rugged in construction and economical to manufacture.

Figure 1:
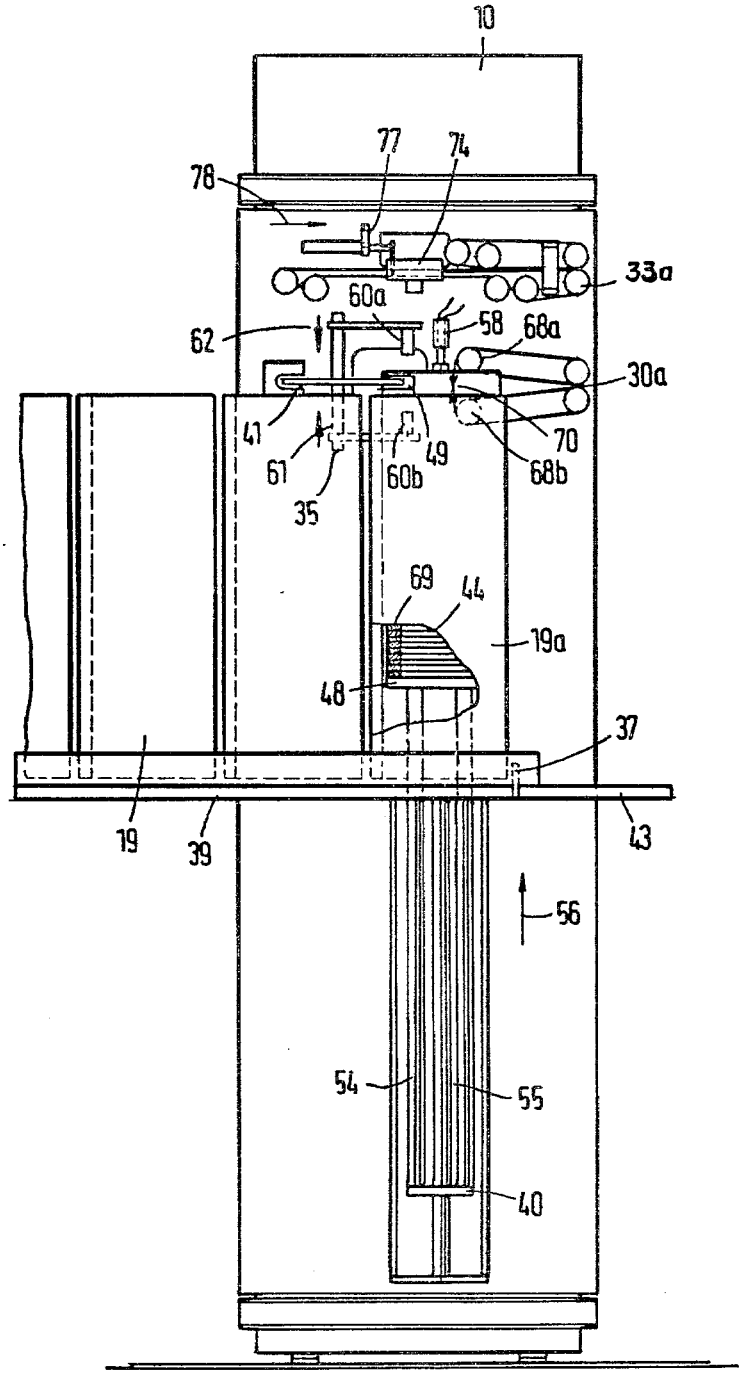
FIG. 1 schematically illustrates an apparatus in accordance with the invention for emptying magazines having a plurality of packets of bills bound by straps.

FIGS. *3a* to *3c* are top plan views, partly in section, of the magazine received in a sorting assembly, showing the individual phases of the separation of the straps and bills of a packet from each other.

DETAILED DESCRIPTION OF THE PREFERRED EMBODIMENTS

Referring to the drawings in particular, the invention embodied therein is directed to an apparatus and method for separating a strap from a packet having a stack of thin sheets, such as bank notes, bound by the strap.

FIG. 1 illustrates a packet feeding housing or module 10 of a bill sorting assembly which may include a plurality of such modules. The housing or module 10 is designed for feeding packets of bills or bank notes supplied in packet magazines 19. The packet magazines 19, in which the bills to be sorted are united in packets 44, for example, of one hundred bills by means of straps 69, and fed into module 10 via a supply and delivery table 39, 43 by means of a conveyor (not shown). The processing of the bills is initiated at another location at which the packet magazines 19 are filled by an operator and then locked. A plurality of magazines is continuously received on supply table 39 in standby position. The first packet magazine 19 is fed into a packet separating or unstrapping section 35 and unlocked by means of a lifting mechanism 40. Thereafter, the lifting mechanism 40 elevates the individual bill packets, one after the other, into a position in front of an ejector or ejector arm 41, mounted in the module which pushes the packets out of the packet magazine 19 into module 10. Thereupon, each pack 44 pushed out of magazine 19 is unstrapped and directed through a bill conveying section 30*a*, to a subsequent module, where the bills are individually separated and fed from the packet. The strap withdrawn from the packet is transferred, by a deviating mechanism (not shown) to a conveying section 33*a* extending spatially above the pack conveying section. After a packet magazine 19 is emptied, the lifting mechanism 40 lowers the empty magazine 19 to delivery table 43. The next filled magazine 19 is automatically advanced, unlocked and emptied as described above.

Figure 2:
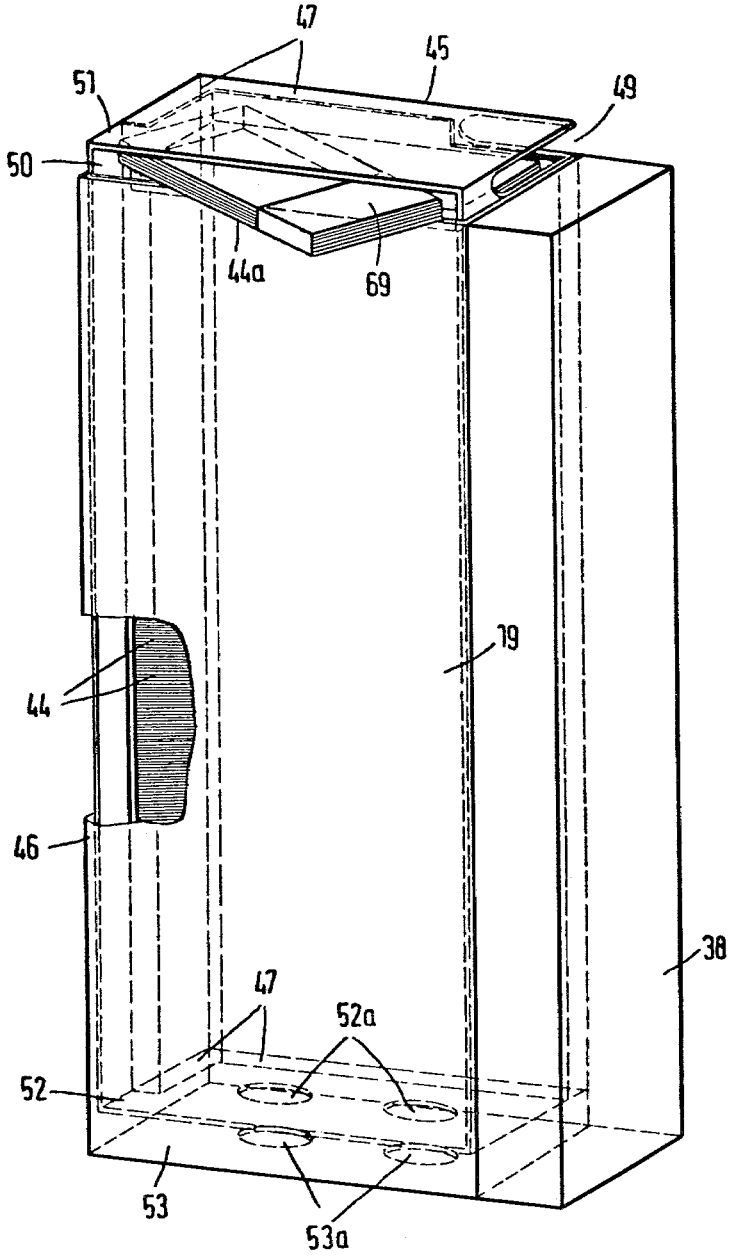
FIG. 2 is a perspective view, partly in section, of the magazine.

FIG. 2 is a perspective view of a packet magazine 19 which affords security against undetected and unauthorized access, due to the special design and the integrated locking mechanism (not shown). Once the packet magazine 19 is filled with bill packets 44 by an authorized person and locked, manual holding of the bill packet is no longer possible without visibly destroying the magazine. Only the sorting device is capable of unlocking the magazine in order to remove the individual bill packets 44 through a slot (packet separation gap 50), having the clearance of a packet. Since seat 50 is only as wide as a packet, the remaining contents of the magazine remain inaccessible during the withdrawal of individual packets.

Packet magazine 19 has two elements, a drawer-like slide-in element 45, and a receptacle or receiving element 46 for accommodating the reception of element 45. Slide-in element 45 can be completely withdrawn from receiving element 46 in the manner of a drawer in order to be filled with bill packets. FIG. 2 shows the magazine in its operating phase. In this phase, element 45 is slightly lifted from within receiving element 46, by means of the lifting mechanism, to partly expose the open side of element 45, by a width approximately corresponding to the thickness of a bill packet. Through the packet separation gap 50 thus formed, the respective uppermost packet 44*a* of the stack of packets swivelled out of slide element 45, as will be explained hereafter. During such operation, the packets therebelow remain within element 45.

As shown in FIG. 2, the drawer member or drawer-like slide-in element 45 has a rear wall, a slide wall, at least one end wall and a front having an open side or opening dimensioned to pass at least one packet. The drawer member 45 is movable relative to the receptacle or receiving element 46.

Basically, slide-in element 45 is dimensioned to the unit size of receiving element 46. To adapt the interior of element 45 to the specific size of bills to be treated, the interior clearance can be adjusted by means of a corresponding adapter piece or insert 47.

The uppermost packet 44*a* of the stack of packets received in slide in element 45 is pushed out by means of an ejector arm 41, shown in FIGS. *3a–3c*, which is guided through an ejection slot 49 in the rear wall proximate the end wall provided opposite to the location of the separation gap 50, and extending across one corner. The side of the uppermost packet 44*a* (FIG. 2) provided with the trap 69 is pushed out from slide-in element 45 in a pivotal motion. To permit the pivotal or swivelling motion of the packet, the adapter piece 47 is provided with a recess 51 at its end diametrically opposite to ejection slot 49. The respective bottoms 52, 53 of the elements 45, 46 have two bores 52*a*, 53*a* provided in alignment one above the other. Two rods 54, 55 (FIG. 1) of lifting mechanism 40 which extend through the bores, with the interposition of a supporting plate 48, push the stack of bill packets 44 upwardly and thereby also urge slide-in element 45 out of receiving element 46. The effect is that, as the operation with the magazine 19 is started and after each separation of a packet, the next uppermost bill packet of the stack is advanced into a position in front of ejector arm 41.

To fill of refill the slide-in element 45 with bill packets 44, slide-in element 45 is brought into a filling station (not shown), where it is unlocked and completely withdrawn from receiving element 46. After the filling operation, slide-in element 45 is again placed into receiving element 46 and locked by means of a locking mechanism (not shown shown). The locking mechanism illustrated schematically in FIG. 1, is housed in a space 38 provided in receiving element 46 on the narrow side thereof. The two elements 45, 46 are conformed in length to each other to the effect so that as they are emboxed in respect to each other, both ejection slot 49 and pack separation gap 50 of slide-in element 45 are completely covered by the corresponding elongated side walls of receiving element 46. The locking mechanism is actuated as the two elements are telescoped into each other, and this prevents any manual access to bill packets 44. Without a special unlocking mechanism which is provided both at the filling station and at the packet separation station of housing or module 10, slide-in element 45 cannot be withdrawn again.

A possible design of the magazine locking system as well as further measures for securing the contents of a magazine against unauthorized handling are disclosed in German published patent application (DT-OS) No. 2202930. The locking mechanism does not belong to the subject matter of the present application and is, therefore, not described here.

Since unauthorized withdrawal of individual bills or bill packets is not possible without destroying the magazine, the contents of a magazine on its way from the filling station to the bill sorting station cannot be manipulated in an undetected manner. The entire system from the magazine filling to the output of sorted bills is therefore contained within a unit which can be continuously supervised and operated without additional labor costs.

Figure 3A:
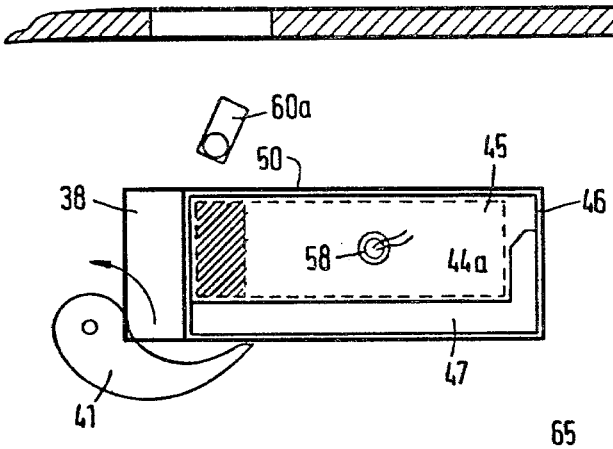
Figure 3B:
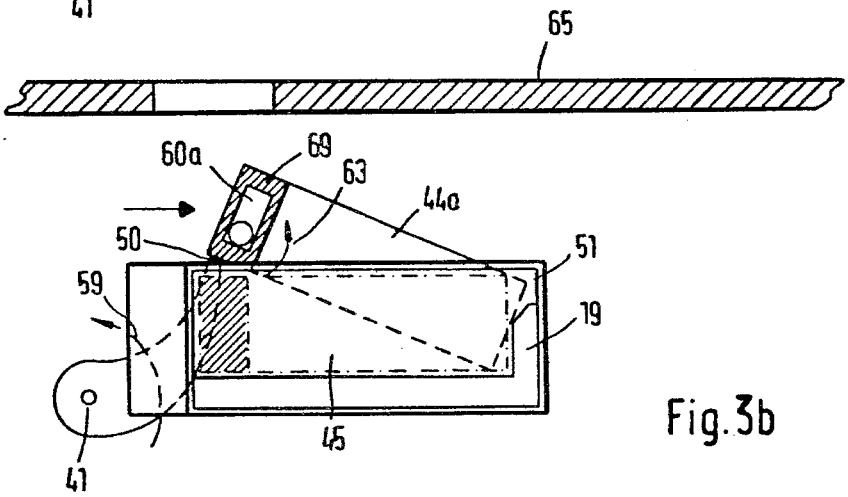

In the following, the operational steps of packet separation are described in more detail with reference to FIGS. 1 and 2 and the schematic illustration of FIGS. 3*a* to 3*c*.

A locked magazine 19 filled with bill packets 44 is advanced by means of a suitable conveyor system (not shown), from supply table 39 into the pack separation station 35 of module 10 (FIG. 1). This takes place after the preceding magazine has been emptied and conveyed to delivery table 43. As soon as the filled magazine abuts against a retractable stop 37, comes into its emptying position (position of magazine 19*a* in FIG. 1) and after the unlocking mechanism has been released, rods 54, 55 of lifting mechanism 40 move upwardly in the direction of arrow 56. The rods pass through bores 52*a*, 53*a* of the receiving and the slide-in elements 45, 46 and abut against supporting plate 48, thereby displacing the stack of bill packets 44 placed thereon, as well as slide-in element 45, upwardly and slightly out of receiving element 46, until ejecting slot 49 and separation gap 50 in whose plane the uppermost pack 44*a* of the stack is lying, are exposed. This is the position of magazine 19*a* in the packet separation and unstrapping station 35 of module 10, as shown in FIG. 1. As shown in FIG. 2, the pocket magazine 19 is turned about its longitudinal axis, so that in FIG. 1, the viewer faces ejection slot 49.

To be able to control the introduction of rods 54, 55 into packet magazine 19 as a function of the height of the stack, use is made of the signal delivered by a pressure sensor 58 mounted in unstrapping station 35 above the magazine. The pressure sensor 58 is actuated by slide-in element 45 to stop lifting mechanism 40 as soon as the slide-in element exerts a predetermined lifting pressure on the sensor (see also FIG. 3*a*). Then, ejector arm 41 pivotally mounted at the level of ejection slot 49 executes a rotary motion in the direction of arrow 59 (FIG. 3*b*) until the end portion of the uppermost pack 44*a*, carrying the strap 69, is completely pushed out of slide-in element 45. Since the width of separation gap 50 (FIG. 2) corresponds to the thickness of only one packet, the subjacent packet remains in slide-in element 45. With the packet in the half ejection position shown in FIG. 3*b* which, incidentally demonstrates the necessity of providing the recess 51, ejector arm 41 is returned to its initial position shown in FIG. 3*a*. Thereupon, two suction heads 60*a* and 60*b* (see FIG. 1) of the unstrapping mechanism 35 are moved toward each other in the directions indicated by arrows 61, 62, until they engage and compress therebetween the end portion of the packet 44*a* which has been pushed out of magazine 19*a* and which is carrying the strap 69. Then, suction pressure is applied to the two suction heads by connecting them to a vacuum pump (not shown).

Figure 3C:
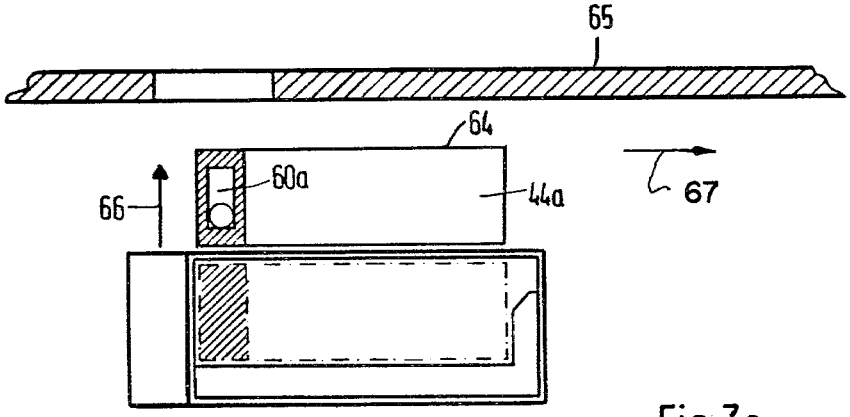

As soon as pack 44*a* is formly clamped by the compressive pressure, both suction heads 60*a*, 60*b* are synchronously pivoted about their own axes of rotation, in the direction of arrow 63 (FIG. 3*b*) until they have turned the pack into the position shown in FIGS. 3*c*.

In the position shown in FIG. 3*c*, the longer edge 64 of packet 44*a* is spaced from a wall 65 of module 10, more or less, depending on the size of the packet. To obtain a uniformly defined position for any packet size, a final movement of the two suction heads 60*a*, 60*b* in the direction of wall 65 (arrow 66) is provided. In the position shown in FIG. 3*c*, the leading edge of pack 44*a*, considered in the packet advance direction indicated by arrow 67, is located between first two movably mounted, driving rollers 68*a*, 68*b* of the pack conveying section 30*a* (see FIG. 1). After the last-mentioned movement of the pack is completed, the compressive pressure of suction heads 60*a*, 60*b* is discontinued, so that the packet end portion carrying the strap 69 is no longer clamped and is retained only by the suction force of suction heads 60*a*, 60*b*. A signal for for unstrapping the pack is delivered, and the first driving rollers 68*a*, 68*b* of pack conveyor section 30*a*, disposed and below the packet, are moved toward each other (arrow 70 in FIG. 1) until, after their short pivotal motion, the packet is firmly clamped therebetween. Thereafter, rollers 68*a*, 68*b* are rotatably actuated and packet 44*a* is pulled out of strap 69, which is firmly retained by suction head 60*a*, 60*b*, and advanced in the direction of arrow 67, to a stand-by station in a following module. Strap 69, which is thereby released, is directed, by suction heads 60*a*, 60*b* and through an opening 72 in mounting wall 65, to a branched strap conveying system (not shown).

Obviously, packet separating station 35 may also be designed differently. Only one possible embodiment thereof suitable for the invention has been described in the foregoing. The ejection slot 29, for example, might be designed otherwise and the bill packets could be pushed out of the magazine in a side-parallel translatory motion, by means of suitable mechanical fingers.

While a specific embodiment of the invention has been shown and described in detail to illustrate the application of the principles of the invention, it will be understood that the invention may be embodied otherwise without departing from such principles.

What is claimed is:

1. An apparatus for separating a strap from a packet having a stack of thin sheets, such as bank notes, bound by the strap comprising: a housing, a magazine disposed within said housing having a receptacle and a drawer member movably received in said receptacle adapted to contain a plurality of the packets, said drawer member having a rear wall, a side wall, at least one end wall and a front with an opening dimensioned to pass at least one packet, said rear wall having a slot proximate said end wall and opposite said opening, means mounted in said housing for moving said end wall and at least part of said drawer member containing one of the packets out of said receptacle, ejector means pivotally mounted in said housing being extendable through said slot when at least part of said drawer member is moved out of said receptacle to eject at least part of one of said packets from said drawer member, first gripping means in said housing engageable with the strap of an ejected packet and second gripping means in said housing engageable with the stack of an ejected packet, and said second gripping means being operative to move said stack relative to said strap and thereby separate said strap from said stack.

2. The apparatus of claim 1, further comprising means mounted in said housing for terminating the advance of said drawer in relation to the thickness of one of the packets.

3. The apparatus of claim 1, wherein said drawer member is movable relative to said receptacle between a closed first position and a second position in which at least one of the packets may be ejected from said drawer through said opening.

4. The apparatus of claim 3, further comprising means for locking said drawer member in said closed first position.

5. The apparatus of claim 4, wherein said drawer member includes an opposite end opposite said end wall, said opposite end having a drawer aperture, said second moving means being operative through said drawer aperture for pushing the packets into engagement with said end wall.

6. The apparatus of claim 5, wherein said receptacle includes a receptacle aperture in a portion thereof adjacent said opposite end, said receptacle aperture being aligned with said drawer aperture, and moving means being operative through said receptacle aperture.

7. The apparatus of claim 1, wherein said drawer member includes an opposite end opposite said end wall, said opposite end having a drawer aperture, and said moving means being operative through said drawn aperture for pushing the packets into engagement with said end wall.

8. The apparatus of claim 7, wherein said receptacle includes a receptacle aperture in a portion thereof adjacent said opposite end, said receptacle aperture being aligned with said drawer aperture, and moving means being operative through said receptacle aperture.

9. The apparatus of claim 8, further comprising a plate member movably disposed in said drawer intermediate said opposite end and said plurality of the packets.

10. The apparatus of claim 1, further comprising an adapter member fixedly received in said drawer member, said adapter member lining at least part of said side walls and said rear wall so as to adapt the packet containing volume of said drawer member to the dimension of said packets, said adapter member having a separating slot at least partly opposite said slot of said rear wall.

11. The apparatus of claim 1, wherein said first gripping means includes means for applying suction pressure to said strap.

12. The apparatus of claim 11, wherein said first gripping means includes a pair of oppositely disposed spaced members, said members being operative to move toward each other and thereby engage a strap of an ejected packet.

13. The apparatus of claim 12, in which said feed gripping means includes means for pivotally moving said spaced members for aligning the said stack of an ejected packet for engagement with said second gripping means.

14. The method of separating a strap from a packet having a stack of thin sheets, such as bank notes, bound by the strap comprising: delivering a plurality of the packets in a locked container of the type having a drawer member containing said packet movably received within a receptacle to a housing, unloading the container within said housing, moving the drawer at least partly out of the receptacle into alignment with an ejector means mounted in said housing, operating said ejector means to eject at least part of at least one of said packets from the drawer, gripping the strap of the ejected packet with a first gripping means and gripping the stack of the ejected packet with a second gripping means, and moving the first and second gripping means relative to each other to separate the strap and the stack.

15. An apparatus for separating a packet having a stack of thin sheets, such as bank notes, each bound by a strap from a magazine containing a pile of such packets comprising: a housing, a magazine disposed within said housing having a receptacle and a drawer member movably received in said receptacle adapted to contain a plurality of the packets, said drawer member having a rear wall, side walls, end walls and an open front side, means mounted in said housing for moving said pile of packets and said drawer member out of said receptacle to such extent that the open front side of the drawer member and the upper edge of the receptacle form a packet separating slot and ejector means mounted in said housing for ejecting the uppermost packet through the packet separating slot.

16. The apparatus of claim 15, wherein said drawer member has an ejector opening opposite said open front side.

17. The apparatus of claim 16, wherein the width of said separating slot is adjusted to the thickness of the packets in the magazine.

18. The apparatus of claim 16 or 17 further comprising adapter means connectable to the side wall defining a base of said drawer member for adjusting the size thereof of the size of said packets to be processed.

19. The apparatus of claim 18 wherein said adapter means has a recess on the side diagonally opposite to said ejector seat for facilitating the ejection of said packets through said separating slot.

20. The apparatus of claim 19 wherein said drawer member includes first bores in the base, and said housing includes second bores in alignment with said first bores and further comprising bore rods extending through said first and second bores.

21. The apparatus of claim 20 further comprising a displaceable plate provided on the base.

22. The apparatus of claim 15, wherein the width of said separating slot is adjusted to the thickness of the packets in the magazine.

23. The apparatus of claim 22 further comprising adaptor means connectable to the side wall defining a base of said drawer member for adjusting the size thereof of the size of said packet to be processed.

24. The apparatus of claim 23, wherein said adapter means has a recess on the side diagonally opposite to said ejector slot for facilitating the ejection of said packets through said separating slot.

25. The apparatus of claim 15 or 16 or 17 or 24, wherein said drawer member includes first bores in the base, and said housing includes second bores in alignment with said first bores, and further comprising bore rods extending through said first and second bores.

* * * * *